US007551045B2

(12) United States Patent
Shih

(10) Patent No.: US 7,551,045 B2
(45) Date of Patent: Jun. 23, 2009

(54) DUAL CHANNEL BAND-PASS FILTER

(75) Inventor: Yen-Yi Shih, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 164 days.

(21) Appl. No.: 11/309,721

(22) Filed: Sep. 15, 2006

(65) Prior Publication Data

US 2007/0200650 A1 Aug. 30, 2007

(30) Foreign Application Priority Data

Feb. 24, 2006 (TW) ..... 95106274

(51) Int. Cl.
*H01P 1/20* (2006.01)

(52) U.S. Cl. ..... 333/204; 333/202; 333/203

(58) Field of Classification Search ..... 333/202–204
See application file for complete search history.

(56) References Cited

U.S. PATENT DOCUMENTS 5,115,216 A * 5/1992 Hikita et al. ..... 333/195
5,888,942 A * 3/1999 Matthaei ..... 505/210
6,122,533 A * 9/2000 Zhang et al. ..... 505/210
6,130,189 A * 10/2000 Matthaei ..... 505/210
6,472,959 B1 * 10/2002 Beaudin et al. ..... 333/193
6,888,425 B2 5/2005 Matsui et al.
2003/0001696 A1 * 1/2003 Yoshida et al. ..... 333/193

FOREIGN PATENT DOCUMENTS

CN 1507108 A 6/2004

* cited by examiner

*Primary Examiner*—Vibol Tan
(74) *Attorney, Agent, or Firm*—Wei Te Chung

(57) ABSTRACT

A dual channel band-pass filter (10) includes an input portion (100), a first resonator (140), a second resonator (160), and an output portion (120). The input portion is used for inputting electromagnetic signals. The first resonator is electronically connected to the input portion, and includes a first groove (146) in the vicinity of a center thereof. The second resonator is disposed parallel to the first resonator, and includes a second groove (166) in the vicinity of a center thereof. The output portion is disposed parallel to the input portion, and is electronically connected to the second resonator for outputting electromagnetic signals.

15 Claims, 3 Drawing Sheets

DUAL CHANNEL BAND-PASS FILTER

FIELD OF THE INVENTION

The present invention generally relates to filters, and more particularly to a dual channel band-pass filter.

RELATED ART

Recently, there has been a significant growth in WLAN (wireless local network) technology due to the ever growing demand of wireless communication products. Such growth becomes particularly prominent after promulgation of IEEE 802.11 WLAN protocol in 1997. IEEE 802.11 WLAN protocol not only offers many novel features to the current wireless communications, but also provides a solution of enabling two wireless communication products manufactured by different companies to communicate to each other. As such, the promulgation of IEEE 802.11 WLAN protocol is a milestone in the development of WLAN.

A peak transmission rate of mobile phones with WiFi (Wireless Fidelity) functions is 54 Mpbs, a peak transmission rate of GSM (Global System for Mobile Communications) mobile phones is 9.6 Kpbs.

Nowadays, many mobile manufacturers produce a so-called dual-mode mobile phone that supports both a WiFi system and a GSM system, the dual-mode mobile phone may operate in a GSM frequency of 1.9 GHz or a WLAN frequency of 2.4 GHz by use of a dual channel band-pass filter. A traditional dual channel band-pass filter, however, has inferior filter function.

Therefore, a heretofore unaddressed need exists in the industry to overcome the aforementioned deficiencies and inadequacies.

SUMMARY

A dual channel band-pass filter includes an input portion, a first resonator, a second resonator, and an output portion. The input portion is used for inputting electromagnetic signals. The first resonator is electronically connected to the input portion, and includes a first groove in a vicinity of a center thereof. The second resonator is disposed parallel to the first resonator, and includes a second groove in the vicinity of a center thereof. The output portion is disposed parallel to the input portion, and is electronically connected to the second resonator for outputting electromagnetic signals.

Other objectives, advantages and novel features of the present invention will be drawn from the following detailed description of preferred embodiments of the present invention with the attached drawings, in which:

DETAILED DESCRIPTION OF THE EMBODIMENTS

Figure 1:
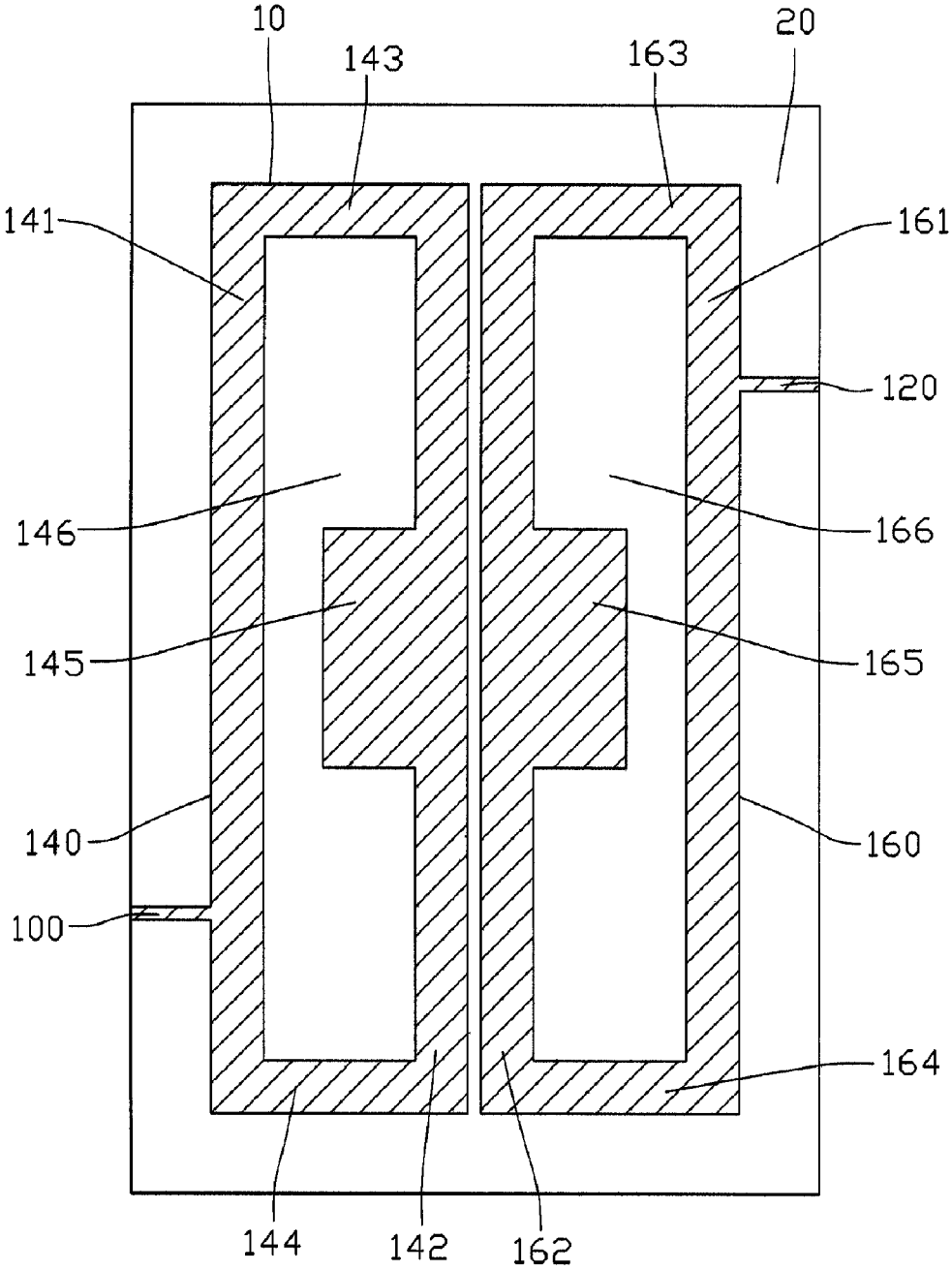
FIG. 1 is a schematic diagram of a dual channel band-pass filter in accordance with an exemplary embodiment of the invention.

FIG. 1 is a schematic diagram of an exemplary dual channel band-pass filter 10 of an exemplary embodiment of the present invention.

In this embodiment, the dual channel band-pass filter 10 is mounted on a printed circuit board (PCB) 20. The dual channel band-pass filter 10 includes an input portion 100, an output portion 120, a first resonator 140, and a second resonator 160.

The input portion 100 is used for inputting electromagnetic signals, the output portion 120 is used for outputting electromagnetic signals. The input portion 100 is parallel to the output portion 120, and electronically connected to the first resonator 140. The second resonator 160 is symmetrical to the first resonator 140, and electronically connected to the output portion 120. A shape of the first resonator 140 is the same as that of the second resonator 160.

The first resonator 140 includes a first external portion 141, a first internal portion 142, a first connecting portion 143, and a second connecting portion 144. A first protrusion 145 is disposed in the vicinity of a center of the first internal portion 142. The first external portion 141 is parallel to the first internal portion 142. A length of the first external portion 141 is the same as that of the first internal portion 142. The first connecting portion 143 is parallel to the second connecting portion 144. A length of the first connecting portion 143 is the same as that of the second connecting portion 144. The first external portion 141 and the first internal portion 142, are connected to each other at ends thereof by the first connecting portion 143, and the second connecting portion 144, to cooperatively define a first void or a first groove 146.

The second resonator 160 includes a second external portion 161, a second internal portion 162, a third connecting portion 163, and a fourth connecting portion 164. A second protrusion 165 is disposed in the vicinity of a center of the second internal portion 162. The second external portion 161 is parallel to the second internal portion 162. A length of the second external portion 161 is the same as that of the second internal portion 162. The third connecting portion 163 is parallel to the fourth connecting portion 164. A length of the third connecting portion 163 is the same as that of the fourth connecting portion 164. The second external portion 161 and the second internal portion 162 are connected to each other at ends thereof by the third connecting portion 163 and the fourth connecting portion 164, to cooperatively define a second void or a second groove 166.

The third connecting portion 163 is aligned with the first connecting portion 143, the fourth connecting portion 164 is aligned with the second connecting portion 144. The first internal portion 142 is disposed adjacent to the second internal portion 162. The first protrusion 145 is exposed to the first external portion 141, and the second protrusion 165 is exposed to the second external portion 161.

Figure 2:
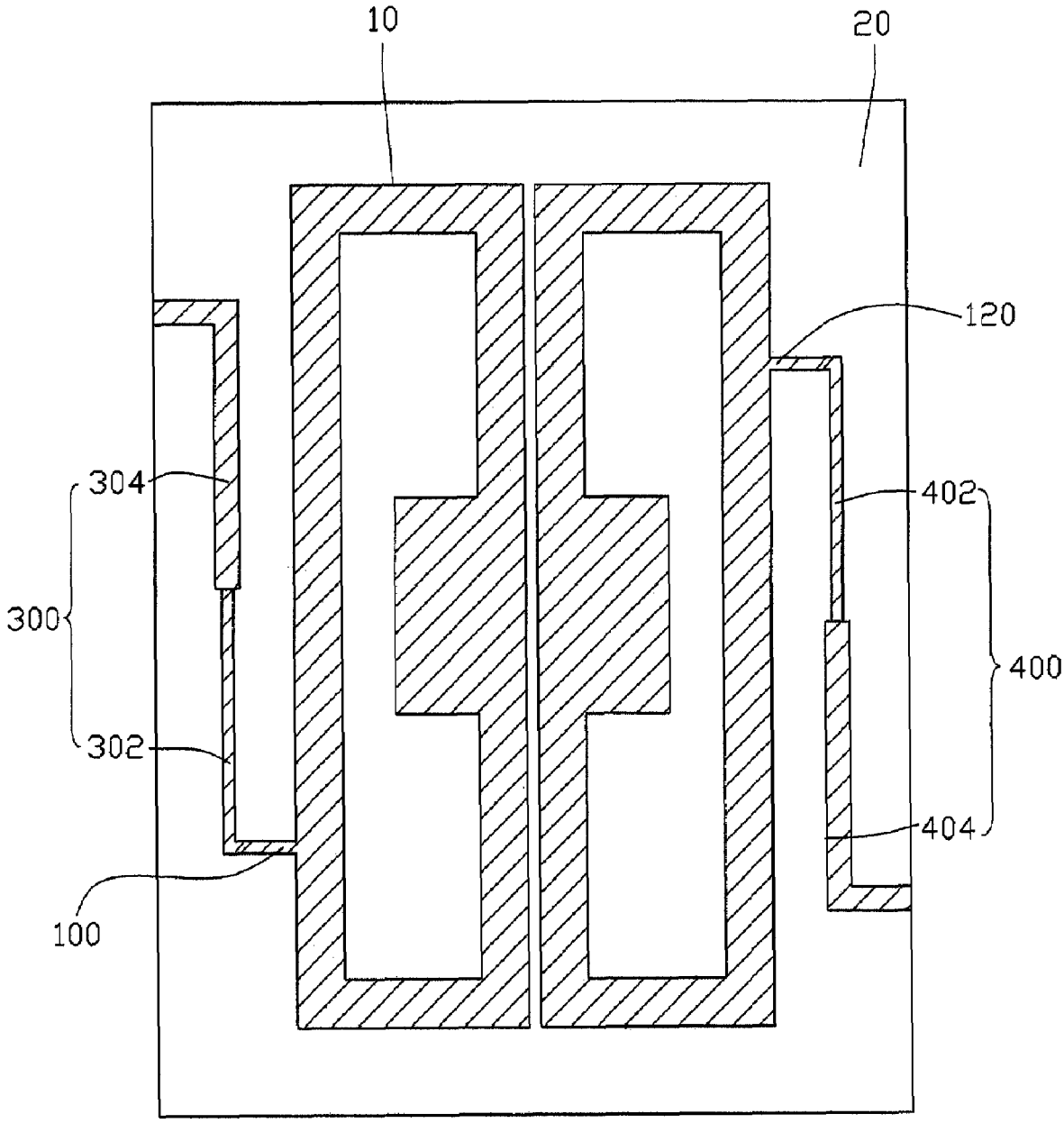
FIG. 2 is a schematic diagram of a dual channel band-pass filter in accordance with another exemplary embodiment of the invention.

Referring to FIG. 2, a dual channel band-pass filter 30 in accordance with another exemplary embodiment of the invention is shown. Differences between the filter 30 and the filter 10 are the addition of converters. In the filter 30, the input portion 100 is electronically connected to a first converter 300, and the output portion 120 is electronically connected to a second converter 400. The first converter 300 includes a first converting portion 302 and a second converting portion 304. The second converter 400 includes a third converting portion 402 and a fourth converting portion 404. One end of the first converting portion 302 is electronically connected to the input portion 100, and the other end of the first converting portion 302 is electronically connected to the second converting portion 304. One end of the second converting portion 304 is electronically connected to the first converting portion 302, and the other end of the second converting portion 304 is electronically connected to a radio frequency module (not shown). One end of the third converting portion 402 is electronically connected to the output portion 120, and the other end of the third converting portion 402 is electronically connected to the fourth converting portion 404. One end of the fourth converting portion 404 is electronically connected to the third converting portion 402, the other end of the fourth converting portion 404 is electronically connected to an antenna module (not shown).

In this embodiment, impedances of the first converting portion 302 and the third converting portion 402 are set to 95 ohm, and impedances of the second converting portion 304 and the fourth converting portion 404 are set to 68 ohm.

Figure 3:
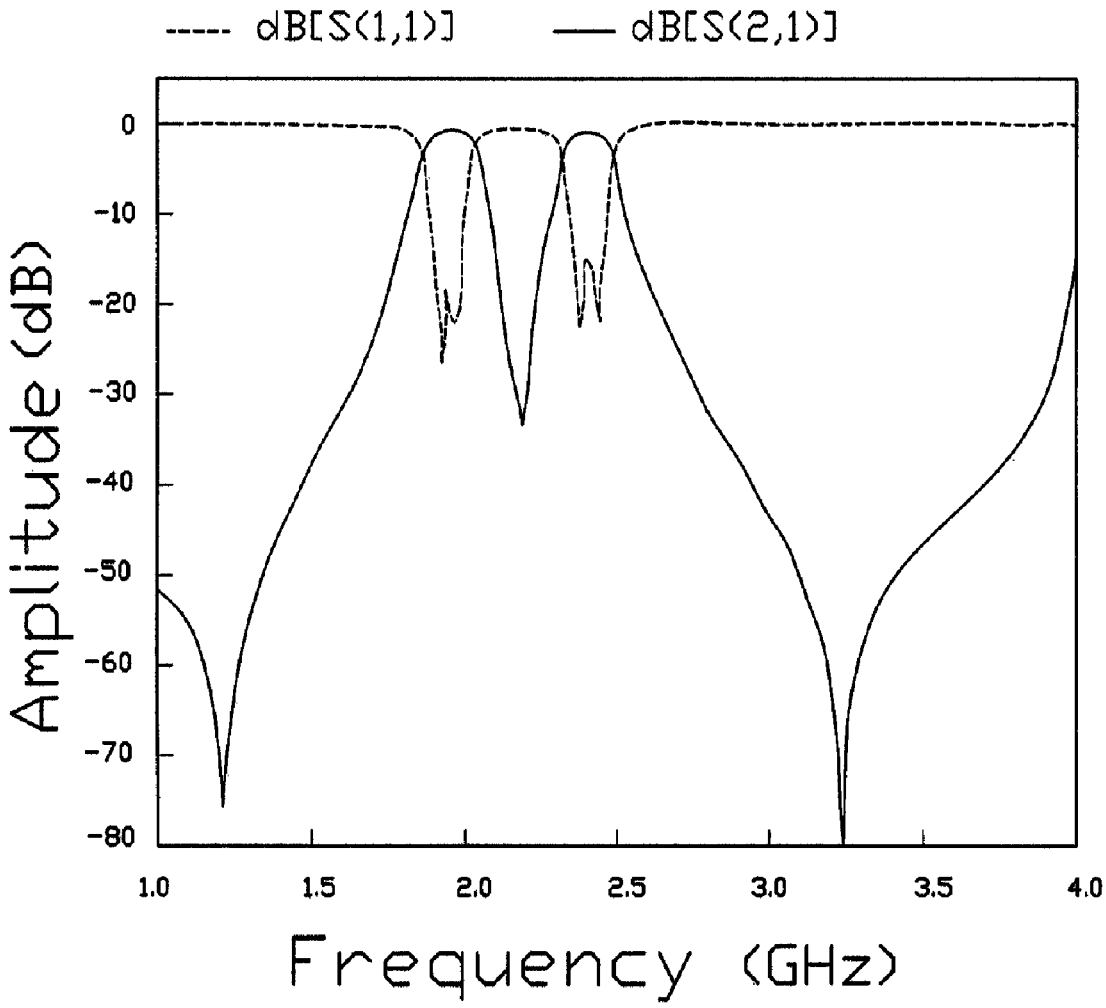
FIG. 3 is a graph showing a relationship between an amplitude of insertion/return loss and a frequency of electromagnetic signals traveling through the dual channel band-pass filter of FIG. 1.

FIG. 3 is a graph showing a relationship between an amplitude of insertion/return loss and a frequency of electromagnetic signals traveling through the dual channel band-pass filter 10 of FIG. 1.

As shown in FIG. 3, a horizontal axis represents the frequency (in GHz) of the electromagnetic signals traveling through the dual channel band-pass filter 10, and a vertical axis represents the amplitude of insertion/return loss (in dB) of the dual channel band-pass filter 10. The insertion loss of the electromagnetic signals traveling through the dual channel band-pass filter 10 is indicated by the curve labeled dB[S(2,1)] and indicates a relationship between input power and output power of the electromagnetic signals traveling through the dual channel band-pass filter 10, and is represented by the following equation:

$$\text{Insertion Loss}=10*\text{Log}\,[(\text{Output Power})/(\text{Input Power})]$$

When the electromagnetic signals travels through the dual channel band-pass filter 10, a part of the input power is returned to a source of the electromagnetic signals. The part of the input power returned to the source of the electromagnetic signals is called a return power. The return loss of the electromagnetic signals traveling through the dual channel band-pass filter 10 is indicated by the curve labeled dB[S(1,1)] and indicates a relationship between input power and return power of the electromagnetic signals traveling through the dual channel band-pass filter 10, and is represented by the following equation:

$$\text{Return Loss}=10*\text{Log}\,[(\text{Return Power})/(\text{Input Power})]$$

For a filter, when an output power of electromagnetic signals in a band-pass frequency range is almost equal to an input power thereof, and a return power of the electromagnetic signals is small, it means that a distortion of the electromagnetic signals is small and a performance of the dual channel band-pass filter 10 is good. As seen in FIG. 3, the dual channel band-pass filter 10 has a good performance as a dual channel band-pass filter. The absolute amplitude value of the return loss in the band-pass frequency range is greater than a value of 10.

The dual channel band-pass filter 10 is able to operate at central frequencies other than 1.9 GHz and 2.4 GHz. One having ordinary skills in the art may change a central frequency by modifying dimensions of the first external portion 141, the first internal portion 142, the first connecting portion 143, the second connecting portion 144, the first protrusion 145 in the first resonator 140, and the second external portion 161, the second internal portion 162, the third connecting portion 163, the fourth connecting portion 164, the second protrusion 165 in the second resonator 160.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A dual channel band-pass filter, comprising:

an input portion for inputting electromagnetic signals;

a first resonator electronically connected to the input portion, the first resonator comprising a first groove in the vicinity of a center of the first resonator, a first external portion, and a first internal portion parallel to the first external portion, wherein a length of the first external portion is substantially the same as that of the first internal portion, and the first internal portion comprises a first protrusion disposed in the vicinity of a center of the first internal portion and exposed to the first external portion;

a second resonator disposed parallel to the first resonator, the second resonator comprising a second groove in the vicinity of a center of the second resonator; and an output portion disposed parallel to the input portion and electronically connected to the second resonator, for outputting electromagnetic signals.

2. The dual channel band-pass filter as recited in claim 1, wherein the first resonator is disposed symmetrically to the second resonator.

3. The dual channel band-pass filter as recited in claim 1, wherein a length of the first resonator is substantially the same as that of the second resonator.

4. The dual channel band-pass filter as recited in claim 1, wherein the first resonator further comprises a first connecting portion and a second connecting portion disposed parallel to the first connecting portion, and a length and a width of the first connecting portion are the same as those of the second connecting portion.

5. The dual channel band-pass filter as recited in claim 4, wherein the first external portion and the first internal portion are connected to each other at ends thereof by the first connecting portion and the second connecting portion, to cooperatively define a first groove.

6. The dual channel band-pass filter as recited in claim 4, wherein the second resonator comprises a second external portion and a second internal portion disposed parallel to the first external portion, and a length of the second external portion is the same as that of the second internal portion.

7. The dual channel band-pass filter as recited in claim 6, wherein the second resonator further comprises a third connecting portion and a fourth connecting portion disposed parallel to the third connecting portion, and a length and a width of the third connecting portion are the same as those of the fourth connecting portion.

8. The dual channel band-pass filter as recited in claim 7, wherein the second external portion and the second internal portion are connected to each other at ends thereof by the third connecting portion and the fourth connecting portion, to cooperatively define a second groove.

9. The dual channel band-pass filter as recited in claim 7, wherein the third connecting portion is aligned with the first connecting portion, and the fourth connecting portion is aligned with the second connecting portion.

10. The dual channel band-pass filter as recited in claim 6, wherein the second internal portion comprises a second protrusion disposed in the vicinity of a center of the second internal portion and exposed to the second external portion.

11. The dual channel band-pass filter as recited in claim 6, wherein the first internal portion is disposed adjacent to the second internal portion.

12. A filter comprising:

an input portion for inputting electromagnetic signals into said filter;

an output portion for outputting said electromagnetic signals out of said filter;

a first resonator electrically connectable with said input portion to be signal communicable therewith, a first void definably formed at a center of said first resonator to be enclosed by said first resonator;

a second resonator spaced from and disposed beside said first resonator so as to be signal communicable with said first resonator, said second resonator electrically connectable with said output portion to be signal communicable therewith, a second void definably formed at a center of said second resonator to be enclosed by said second resonator; and at least one protrusion extending away from at least one of said first and second resonators to protrude into a corresponding one of said first and second voids relative to said at least one of said first and second resonators.

13. The filter as recited in claim 12, wherein said at least one protrusion comprises a first protrusion extending away from said first resonator to protrude into said first void and a second protrusion extending away from said second resonator to protrude into said second void.

14. The filter as recited in claim 13, wherein said first protrusion and said second protrusion are arranged to neighbor each other and extends oppositely away from each other.

15. A filter comprising:

an input portion for inputting electromagnetic signals into said filter;

an output portion for outputting said electromagnetic signals out of said filter;

a first resonator electrically connectable with said input portion to be signal communicable therewith and comprising a first internal portion extending spaced from said input portion, a first void definably formed at a center of said first resonator beside said first internal portion;

a second resonator spaced from and disposed beside said first resonator for signal communication with said first resonator, said second resonator electrically connectable with said output portion to be signal communicable therewith, and comprising a second internal portion extending spaced from said output portion and neighboring said first internal portion for said signal communication between said first and second resonators, a second void definably formed at a center of said second resonator beside said second internal portion; and at least one protrusion extending away from at least one of said first and second internal portions to protrude into a corresponding one of said first and second voids relative to said at least one of said first and second internal portions.

* * * * *